US006533003B1

(12) United States Patent
Jacobus et al.

(10) Patent No.: US 6,533,003 B1
(45) Date of Patent: Mar. 18, 2003

(54) ICE DISPENSER DUCT DOOR MECHANISM

(75) Inventors: Dwight William Jacobus, Louisville, KY (US); Wilbur C. Bewley, Lexington, KY (US); Bob D. Merryman, Louisville, KY (US); Diane M. Dehli, Jeffersontown, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/474,963

(22) Filed: Dec. 30, 1999

(51) Int. Cl.[7] ..... B65B 1/04

(52) U.S. Cl. ..... 141/360; 141/82; 222/146.6; 49/29

(58) Field of Search ..... 222/146.6, 556; 62/344; 221/15, 154, 250; 49/29, 30, 386; 141/360–362, 82

(56) References Cited

U.S. PATENT DOCUMENTS 3,942,334 A 3/1976 Pink
4,069,545 A 1/1978 Holet et al.
4,089,436 A 5/1978 Marks
4,090,641 A 5/1978 Lindenschmidt
4,209,999 A 7/1980 Falk et al.
4,220,266 A 9/1980 Braden et al.
4,227,383 A 10/1980 Horvay
4,555,049 A 11/1985 Mawby et al.
4,679,715 A * 7/1987 Hovinga ..... 222/517
4,901,396 A 2/1990 Tatematsu et al.
5,526,854 A 6/1996 Unger

* cited by examiner

*Primary Examiner*—Steven O. Douglas
(74) *Attorney, Agent, or Firm*—Armstrong Teasdale LLP

(57) ABSTRACT

A method of controlling a dispenser duct door, including positioning an upper side of the door, in a closed position, in a door-opening direction, and rotating a bottom end of the door to a partially open position vertically under the upper side of the door in response to an opening signal. The bottom end of the door is rotated further in the door-opening direction in response to ice hitting a rear of the door and is returned to the partially open position. After a predetermined delay, the bottom end of the door is returned to the closed position.

19 Claims, 4 Drawing Sheets

ICE DISPENSER DUCT DOOR MECHANISM

BACKGROUND OF THE INVENTION

This invention relates to refrigerator dispenser doors, and, more particularly, to doors for dispenser ducts for icemakers.

Consumer ice dispensers that dispense through a freezer compartment door typically have a duct door that prevents or restricts warm moist air from entering the refrigerated compartment. The door is held in its sealing position by a bias spring. When either crushed or cubed ice is requested by the user, the duct door is fully opened by several different mechanisms initiated by pressure from a receptacle, usually a drinking glass. When the glass is sufficiently full the user removes the pressure from the mechanisms. A "time delay" mechanism holds the duct door open for a few seconds to allow any ice pieces which are "on their way" to be discharged rather than accumulating in undesirable places in the dispenser system. After this brief delay the bias springs close and seal the duct doors. A main problem with these arrangements has been poor control of crushed ice spray.

BRIEF SUMMARY OF THE INVENTION

It would be desirable to open and close the door with improved control of crushed ice spray. In one embodiment the door is biased toward a first closed position by a first magnetic force. A second magnetic force is then applied to urge the door to a second partially open position. The door is yieldably maintained in the second position until contacted by a dispensed item, such as crushed ice. The door is then moved to a third position more open than the second position in response to the dispensed item contacting the door. The second magnetic force is then released and the door is closed in response to the first magnetic force.

DETAILED DESCRIPTION OF THE INVENTION

Figure 1:
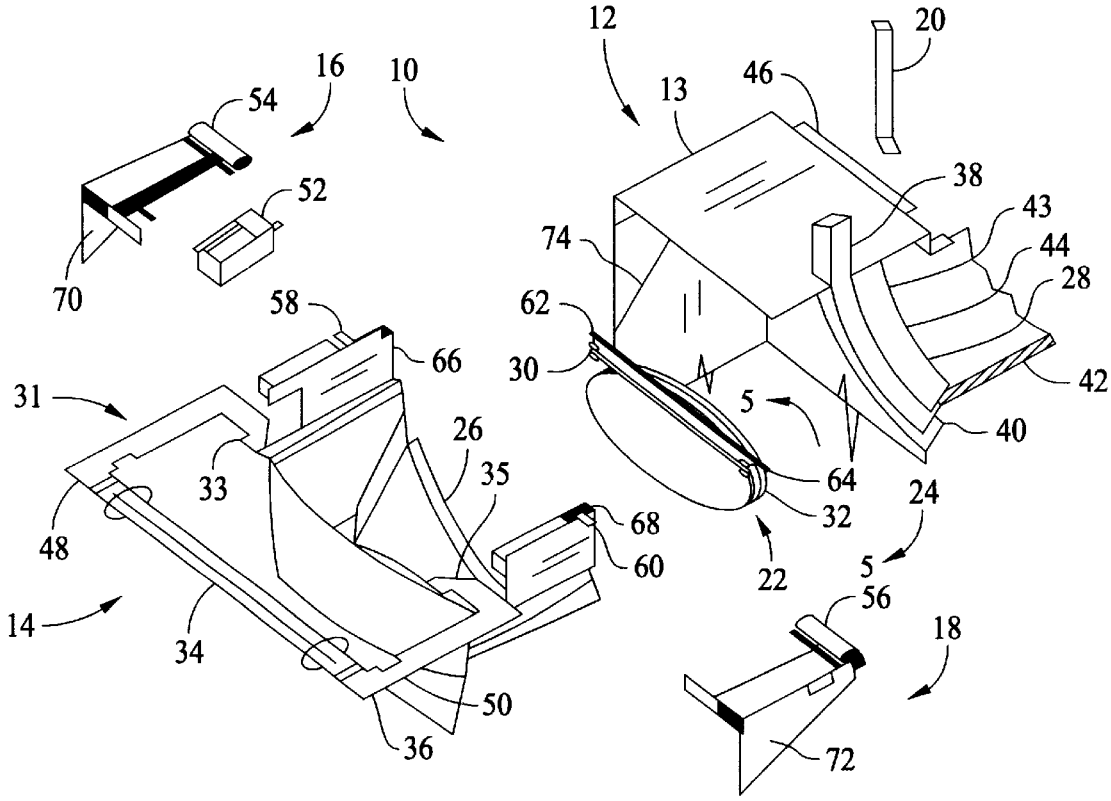
FIG. 1 is an exploded front upper right perspective view of an ice dispenser duct door mechanism.

FIG. 1 is an exploded view of one embodiment of a duct door mechanism 10 is shown. Mechanism 10 includes a recess housing 12, a front section 14, a left section 16, a right section 18, a water supply tube 20 and a door assembly 22. Duct door assembly 22 includes a duct door 24. As will be described below, duct door 24 is not forcibly opened to its extreme. Instead, duct door 24 is opened on "initiation" a minimum amount in the order of ¼ inch. Duct door 24 is free to open further to pass larger ice pieces but returns by gravity to this minimum opening. In this "gravity pendulum" manner door 24 absorbs ice momentum slowing ice down for gentler deliver to the glass. The delivery accuracy is helped by a rigid funnel 26 that completely surrounds a duct outlet 28 and then funnels the opening from the diameter of outlet 28 down to within the diameter of the rim of a majority of glasses. To further help accuracy, funnel 26 moves with the glass, thus taking away the relative motion of some systems.

Mechanism 10 uses permanent magnets 30 and 32 to pull duct door 24 closed from a "minimum opening" position. Then an electromagnet 34 is used to counteract magnets 30 and 32 and open door 24 to the minimum opening and hold door 24 open for a few second "delay" at the end. When DC power is removed from electromagnet 34 permanent magnets 30 and 32 close and seal door 24.

Housing or "recess" 12 has a wall 13 which wraps around the side and top of mechanism 10 to cooperate to define a refrigerator frontal recess (not shown) for dispensing ice and water from a refrigerator (not shown) or the like. Permanent magnets 30 and 32 are ceramic magnets connected by steel bar 36 forming a "horseshoe" or "C" shaped magnet with hooked ends 33 and 35. Magnets 30 and 32 are attracted to the "horseshoe" or "C" shaped iron core 34, 36 of the electromagnet. That is electromagnet core 34, 36 completes an electromagnetic circuit for permanent magnets 30 and 32.

Recess 12 is shown as a cut cross-section with a molded in entrance 38 for drinking water supply tube 20 and a terminal end 40 of an ice duct 42 through a door opening 44 of recess 12. Door opening 44 is selectively sealed and unsealed by door 24.

Iron core 36 of electromagnet 34 reaches around door 24 to be adjacent to permanent magnets 30 and 32 of door assembly 22. Hooked ends 33 and 35 are housed in pockets 46 molded into recess 12. Core 36 is made in two pieces or arms 48 and 50 to facilitate assembly through electromagnet 34, shown as its winding bobbin. Left and right sections 16 and 18 slide over arms 48 and 50 trapping an actuation switch 52 and providing journal bearings 54 and 56 for two pivots 58 and 60 molded onto funnel 26 of front section 14. Door 24 is pivoted on two pivot pins 62 and 64. Door pivot pins 62 and 64 engage two matching openings 66 and 68 provided in rear upper corners of funnel 26. When assembled, triangular shaped faces 70 and 72 of left and right sections 16 and 18 slide up inclined ramps 74 molded into recess 12 and position duct door 24 to seal terminal end 40 of ice duct 42 through door opening 44.

Figure 2:
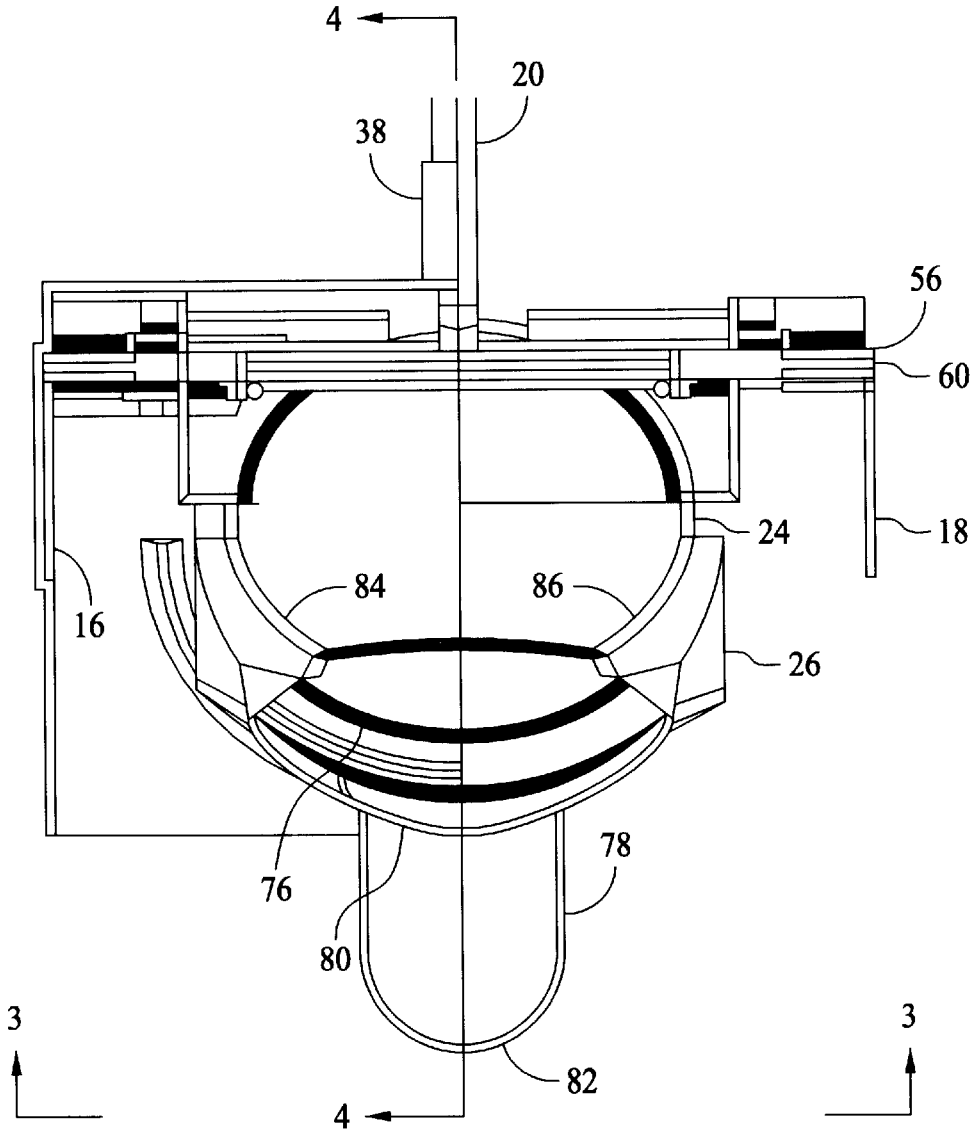
FIG. 2 is a front elevational view of an ice dispenser duct door mechanism, in partial cutaway.

FIG. 2 is a front elevational view of mechanism 10. FIG. 2 is in partial cutaway consistent with FIG. 1. Funnel 26 wraps around a lower portion 76 of door opening 44 and extends forwardly from opening 44. An activation lever tongue 78 is attached to a bottom center rear 80 of funnel 26 and extends downwardly and forwardly from funnel 26 to be contacted by a glass (not shown) during use. In practice a glass would contact a lower edge 82 of tongue 78 and push edge 82 rearwardly. Since funnel 26 in pivotally mounted by pivots 58 and 60 in bearings 54 and 56, funnel 26 also rotates rearwardly and contacts actuation switch 52 to cause electromagnet 34 to be activated and door 24 opened. This allows the glass to move with funnel 26 to eliminate relative movement between the glass and funnel 26, which might otherwise cause ice to miss the glass. Funnel 26 in one embodiment includes integral curved sides 84 and 86 to allow unimpaired vision of dispensed ice while still providing sufficient structural strength.

Figure 3:
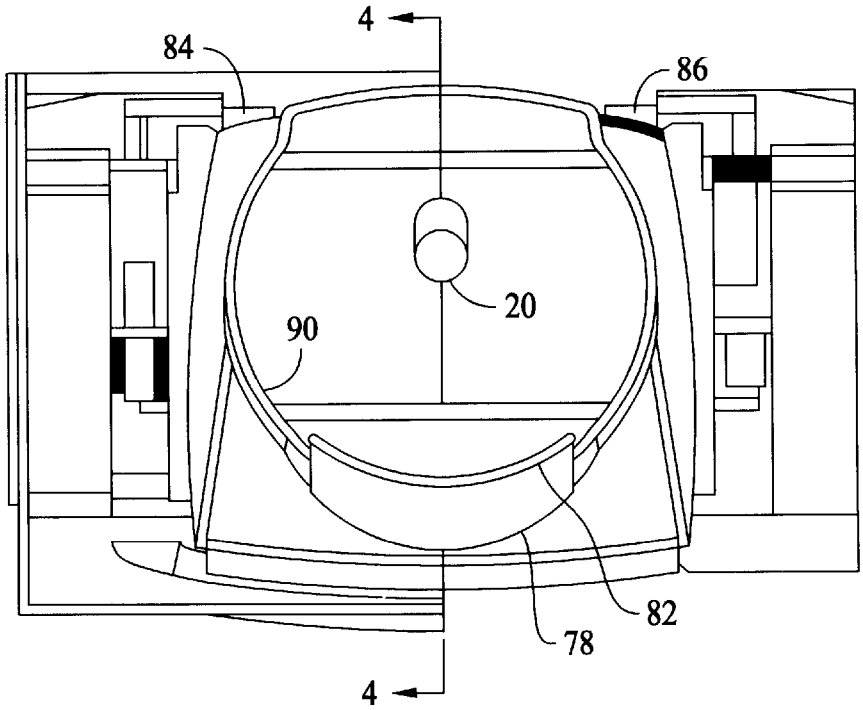
FIG. 3 is a bottom view taken along line 3—3 of FIG. 2.

FIG. 3 is a bottom view taken along line 3—3 of FIG. 2, and therefor is also in partial cutaway. Tongue 78 is seen attached to funnel 26 as previously described. Curved sides 84, 86, and tongue 78 define an dispensing opening 90, through which dispensed ice passes to the glass. Opening 90 is generally circular and of smaller diameter than opening 44.

Figure 4:
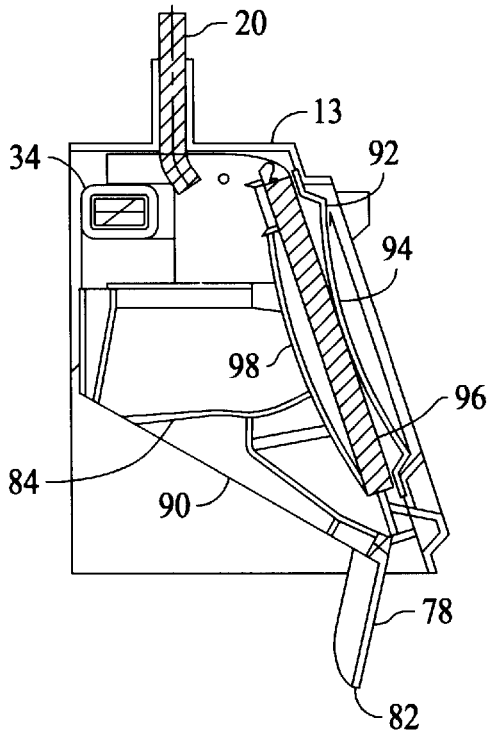
FIG. 4 is a cross-sectional view taken along line 4—4 of FIGS. 2 and 3.

FIG. 4 is a side cross sectional view taken along lines 4—4 of FIGS. 2 and 3. A rear cover 92 of assembly 22 has a concave flexible inner face or center region 94. Assembly 22 includes an insulation layer 96 sandwiched between flexible rear cover 92 and a hard plastic front cover 98.

Figure 5:
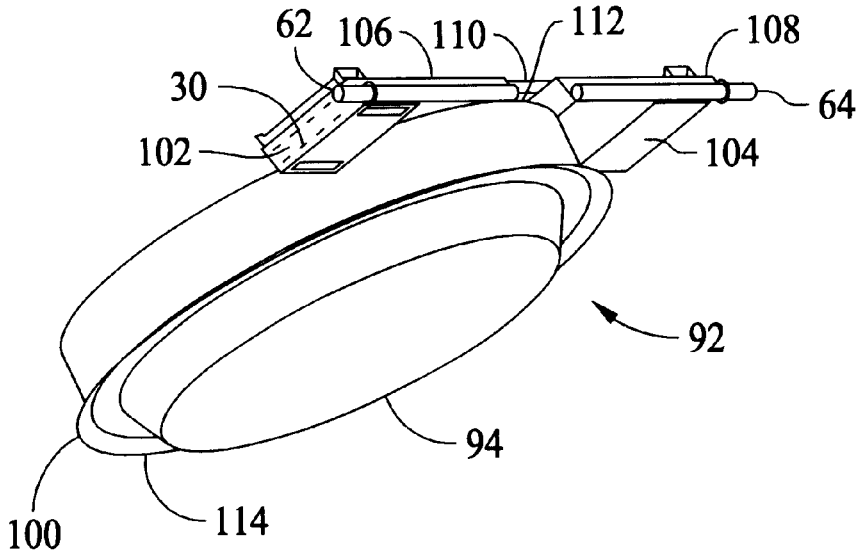
FIG. 5 is a perspective view taken along line 5—5 of FIG. 1.

FIG. 5 is a rear perspective view of assembly 22. Rear cover 92 has a flexible inner face 94 and a flexible perimeter seal lip 100. Magnets 30 and 32 fit in molded in pockets 102 and 104 in two arms 106 and 108 of cover 98. Magnets 30 and 32 are retained by a backing bar 110 extending between arms 106 and 108.

Door 24 is attached at an upper side 112 to pivots 62 and 64 to allow a bottom end 114 of door 24 to swing open. Upper side 112 can be tilted forwardly (outwardly) relative to bottom end 114 so that the gravity neutral position of door 24 is slightly open. Left magnet 30 and right magnet 32 can be provided to hold door 24 shut against the force of gravity tending to open it. This allows falling crushed ice behind door 24 to rapidly open door 24 and to fully empty before magnets 30 and 32 pull door 24 back up shut.

When the user pushes a glass against edge 82, funnel 26 pivots backward around bearings 54 and 56, trips actuation switch 52, and raises duct door 24 slightly. The small relative motion between door 24 and recess 12 amplifies glass pressure to break any sugar or ice bonds that may have formed between the door 24 and recess 12. Breaking sugar or ice bonds helps insure that the small magnetic repulsive forces of electromagnet 34 are able to reliably open the door to its "minimum" every time. A heater (not shown) can be provided in a peripheral region of the door 24, if desired.

The door 24 is biased toward the closed position of FIG. 4 by a first magnetic force of magnets 30 and 32. When a glass (not shown) is pushed against edge 82, tongue 78 is pushed rearward to activate actuation switch 52. This activation of button 52 causes electricity to be applied to electromagnet 34 to apply a second magnetic force opposed to and greater than the first magnetic force to urge the door 24 to a second partially open position. So long as the glass pushes tongue 78, this second magnetic force continues to be applied, thus maintaining the door yieldably in the second position until contacted by a dispensed item (not shown.) When contacted by a dispensed item, such as crushed ice or an ice cube, door 24 is knocked to a third position more open than the second. Rear cover 92 is flexible to more quietly absorb this impact on door 24. However, gravity causes door 24 to quickly return to the second position following such impact. When the user releases pressure of the glass on tongue 78, the second magnetic force is released and the first magnetic force of magnets 30 and 32 closes door 24, preferably after a delay. In a particular embodiment, deactivation of actuation switch 52 reverses electromagnet 34 to reverse the resultant electromagnetic force and attract magnets 30, 32 to close door 24 when tongue 78 is released.

While the invention has been described in terms of various specific embodiments, those skilled in the art will recognize that the invention can be practiced with modification within the spirit and scope of the claims.

What is claimed is:

1. A method of controlling a dispenser door comprising the steps of:

biasing the door toward a first closed position by a first magnetic force;

applying a second magnetic force to urge the door to a second partially open position;

maintaining the door yieldably in the second position until contacted by a dispensed item;

moving the door to a third position more open than the second position in response to the dispensed item contacting the door; and releasing the second magnetic force and closing the door responsive to the first magnetic force.

2. A method in accordance with claim 1 wherein the first and second magnetic forces are opposed to each other.

3. A method in accordance with claim 2 wherein the first magnetic force is applied by a constant force permanent magnet.

4. A method in accordance with claim 3 wherein the second magnetic force is applied by an electromagnet.

5. A method in accordance with claim 4 wherein the second magnetic force is greater than the first constant magnetic force.

6. A method in accordance with claim 1 wherein the first magnetic force is applied by a constant force permanent magnet.

7. A method in accordance with claim 1 wherein the second magnetic force is applied by an electromagnet.

8. A method in accordance with claim 1 wherein the electromagnetic force is applied responsive to movement of a lever positioned adjacent the door in a positioned adapted to be contacted by a receptacle for the dispensed item.

9. A method in accordance with claim 1 wherein the door is maintained in the second position by force of gravity.

10. A method in accordance with claim 9 wherein a bottom of the door is vertically under a pivot of the door when the door is in the second position so that the second position is a gravity-neutral position.

11. A method in accordance with claim 9 wherein the door is a gravity pendulum in the second position.

12. A method in accordance with claim 1 wherein the second position is separated from the first position by a distance within the range of from about ⅛ inch to about ⅜ inch.

13. A method in accordance with claim 1 wherein the dispenser has a funnel and the funnel is moved in the direction of movement of a receptacle for the dispensed item to reduce relative movement between the receptacle and the funnel.

14. A method of controlling an outlet door of a dispenser, said method comprising the steps of:

positioning an upper side of the door, in a closed position, in a door-opening direction;

rotating a bottom end of the door to a partially open position vertically under the top of the upper side in response to an opening signal;

rotating the bottom of the door further in the door-opening direction in response to ice hitting a rear of the door;

returning the bottom end of the door to the partially open position; and returning the bottom end of the door to the closed position after a predetermined delay period following return of the door to the partially open position.

15. A dispenser door control mechanism comprising:

an upper side of the door, in a closed position, tilted in a door-opening direction relative to a bottom end of the door;

a first magnet constantly biasing the door toward said closed position;

a pivot allowing said bottom end of the door to move to and past a partially open position in response to opening forces;

a second magnet adapted to selectively apply, in response to a signal, a door opening force to the door to sufficient to overcome the bias of the first magnet; and a delay mechanism for maintaining a door opening force of a magnet for a preset limited time following discontinuance of said signal.

16. A mechanism in accordance with claim 15 wherein said bottom end of the door in said partially open position is vertically under said upper side of the door.

17. A mechanism in accordance with claim 15 further comprising a funnel adjacent the door, said funnel adapted to move with, and in response to, movement of a receptacle for a dispensed item.

18. A mechanism in accordance with claim 15 wherein the door when in the partially open position is primarily a gravity pendulum adapted for movement in an opening direction from said partially open positioning response to the door being contacted by a dispensed item.

19. A mechanism in accordance with claim 15 wherein the first magnet is a permanent constant force magnet and said second magnet is a selectively activatable electromagnet.

* * * * *

UNITED STATES PATENT AND TRADEMARK OFFICE

CERTIFICATE OF CORRECTION

PATENT NO. : 6,533,003 B1
DATED : March 18, 2003
INVENTOR(S) : Jacobus et al.

It is certified that error appears in the above-identified patent and that said Letters Patent is hereby corrected as shown below:

Column 4,
Line 21, delete “positioned” and insert therefor -- position --.
Line 66, delete “to sufficient” and insert therefor -- sufficient --.

Signed and Sealed this

First Day of July, 2003

JAMES E. ROGAN
*Director of the United States Patent and Trademark Office*